US006552696B1

(12) United States Patent
Sievenpiper et al.

(10) Patent No.: US 6,552,696 B1
(45) Date of Patent: Apr. 22, 2003

(54) ELECTRONICALLY TUNABLE REFLECTOR

(75) Inventors: Daniel Sievenpiper, Los Angeles; Tsung-Yuan Hsu, Westlake Village; Shin-Tson Wu, Northridge; David M. Pepper, Malibu, all of CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 09/537,922

(22) Filed: Mar. 29, 2000

(51) Int. Cl.[7] ..... H01Q 15/02

(52) U.S. Cl. ..... 343/909; 343/700 MS; 343/754

(58) Field of Search ..... 343/700 MS, 754, 343/778, 909, 910, 756; H01Q 15/02

(56) References Cited

U.S. PATENT DOCUMENTS

| | | | | |
|---|---|---|---|---|
| 3,267,480 A | 8/1966 | Lerner | ..... | 343/911 |
| 3,810,183 A | 5/1974 | Krutsinger et al. | ..... | 343/708 |
| 3,961,333 A | 6/1976 | Purinton | ..... | 343/872 |

(List continued on next page.)

FOREIGN PATENT DOCUMENTS

| | | | |
|---|---|---|---|
| DE | 196 00 609 A1 | 4/1997 | |
| EP | 0 539 297 | 4/1993 | |
| FR | 2 785 476 | 5/2000 | |
| GB | 2 281 662 | 3/1995 | |
| GB | 2 328 748 | 3/1999 | |
| WO | 94/00891 | 1/1994 | |
| WO | 96/29621 | 9/1996 | |
| WO | WO 98/21734 | 5/1998 | |
| WO | WO 99/50929 | 10/1999 | ..... H01Q/1/38 |
| WO | WO 00/44012 | 7/2000 | |

OTHER PUBLICATIONS

Balanis, C., "Aperture Antennas", *Antenna Theory, Analysis and Design*, 2nd Edition, (New York, Wiley & Sons, 1997), Chap. 12, pp. 575–597.

Balanis, C., "Microstrip Antennas", *Antenna Theory, Analysis and Design*, 2nd Edition, (New York, John Wiley & Sons, 1997), Chap. 14, pp. 722–736.

Cognard, J., "Alignment of Nematic Liquid Crystals and Their Mixtures" *Mol. Cryst. Lig, Cryst.* Suppl. 1, 1 (1982) pp. 1–74.

Doane, J.W., et al., "Field Controlled Light Scattering from Nematic Microdroplets", *Appl. Phys. Lett.,* vol. 48 (Jan. 1986) pp. 269–271.

Jensen, M.A., et al., "EM Interaction of Handset Antennas and a Human in Personal Communications", *Proceedings of the IEEE*, vol. 83, No. 1 (Jan. 1995) pp. 7–17.

Jensen, M.A., et al., "Performance Analysis of Antennas for Hand–held Transceivers using FDTD", *IEEE Transactions on Antennas and Propagation*, vol. 42, No. 8 (Aug. 1994) pp. 1106–1113.

Ramo, S., et al., *Fields and Waves in Communication Electronics*, 3rd Edition (New York, John Wiley & Sons, 1994) Section 9.8–9.11, pp. 476–487.

(List continued on next page.)

*Primary Examiner*—Tho Phan
(74) *Attorney, Agent, or Firm*—Ladas & Parry

(57) ABSTRACT

A tuneable impedance surface for steering and/or focusing a radio frequency beam. The tunable surface comprises a ground plane; a plurality of elements disposed a distance from the ground plane, the distance being less than a wavelength of the radio frequency beam; and a capacitor arrangement for controllably varying the capacitance of adjacent top plates, the capacitor arrangement including a dielectric material which locally changes its dielectric constant in response to an external stimulus.

28 Claims, 7 Drawing Sheets

U.S. PATENT DOCUMENTS

| | | | | | |
|---|---|---|---|---|---|
| 4,150,382 | A | | 4/1979 | King | 343/754 |
| 4,266,203 | A | | 5/1981 | Saudreau et al. | 333/21 |
| 4,387,377 | A | | 6/1983 | Kandler | 343/756 |
| 4,594,595 | A | | 6/1986 | Struckman | 343/770 |
| 4,749,996 | A | | 6/1988 | Tresselt | 343/700 |
| 4,782,346 | A | | 11/1988 | Sharma | 343/795 |
| 4,843,400 | A | | 6/1989 | Tsao et al. | 343/700 |
| 4,843,403 | A | | 6/1989 | Lalezari et al. | 343/767 |
| 4,853,704 | A | | 8/1989 | Diaz et al. | 343/767 |
| 4,905,014 | A | | 2/1990 | Gonzalez et al. | 343/909 |
| 5,021,795 | A | * | 6/1991 | Masiulis | 343/700 MS |
| 5,023,623 | A | | 6/1991 | Kreinheder et al. | 343/725 |
| 5,081,466 | A | | 1/1992 | Bitter, Jr. | 343/767 |
| 5,115,217 | A | | 5/1992 | McGrath et al. | 333/246 |
| 5,146,235 | A | | 9/1992 | Frese | 343/895 |
| 5,158,611 | A | | 10/1992 | Ura et al. | 106/499 |
| 5,268,701 | A | | 12/1993 | Smith | 343/767 |
| 5,287,118 | A | | 2/1994 | Budd | 343/909 |
| 5,519,408 | A | | 5/1996 | Schnetzer | 343/767 |
| 5,531,018 | A | | 7/1996 | Saia et al. | 29/622 |
| 5,534,877 | A | | 7/1996 | Sorbello et al. | 343/700 |
| 5,541,614 | A | | 7/1996 | Lam et al. | 343/792.5 |
| 5,557,291 | A | | 9/1996 | Chu et al. | 343/725 |
| 5,589,845 | A | * | 12/1996 | Yandrofski et al. | 343/909 |
| 5,611,940 | A | | 3/1997 | Zettler | 73/514 |
| 5,638,946 | A | | 6/1997 | Zavracky | 200/181 |
| 5,694,134 | A | | 12/1997 | Barnes | 343/700 |
| 5,721,194 | A | | 2/1998 | Yandrofski et al. | 505/210 |
| 5,874,915 | A | | 2/1999 | Lee et al. | 342/375 |
| 5,894,288 | A | | 4/1999 | Lee et al. | 343/770 |
| 5,923,303 | A | | 7/1999 | Schwengler et al. | 343/853 |
| 5,945,951 | A | | 8/1999 | Monte et al. | 343/700 |
| 5,949,382 | A | | 9/1999 | Quan | 343/767 |
| 6,005,519 | A | | 12/1999 | Burns | 343/700 |
| 6,040,803 | A | | 3/2000 | Spall | 343/700 |
| 6,054,659 | A | | 4/2000 | Lee et al. | 200/181 |
| 6,075,485 | A | | 6/2000 | Lilly et al. | 343/700 |
| 6,081,235 | A | * | 6/2000 | Romanofsky et al. | 343/700 MS |
| 6,097,263 | A | * | 8/2000 | Mueller et al. | 333/17.1 |
| 6,097,343 | A | | 8/2000 | Goetz et al. | 343/708 |
| 6,118,406 | A | | 9/2000 | Josypenko | 343/700 |
| 6,127,908 | A | * | 10/2000 | Bozler et al. | 333/246 |
| 6,154,176 | A | | 11/2000 | Fathy et al. | 343/700 |
| 6,166,705 | A | | 12/2000 | Mast et al. | 343/853 |
| 6,175,337 | B1 | * | 1/2001 | Jasper et al. | 343/770 |
| 6,246,377 | B1 | | 6/2001 | Aiello et al | 343/770 |

OTHER PUBLICATIONS

Sievenpiper, D., et. al., "High–Impedance Electromagnetic Surfaces with a Forbidden Frequency Band", *IEEE Transactions on Microwave Theory and Techniques*, vol . 47, No. 11, (Nov. 1999) pp. 2059–2074.

Sievenpiper, D., "High–Impedance Electromagnetic Surfaces", *Ph.D. Dissertation*, Dept. of Electrical Engineering, University of California, Los Angeles, CA, 1999.

Wu, S.T., et al., "High Birefringence and Wide Nematic Range Bis–tolane Liquid Crystals", *Appl. Phys. Lett.* vol. 74, No. 5, (Jan. 1999) pp. 344–346.

Bradley, T.W., et al., "Development of a Voltage–Variable Dielectric (VVD), Electronic Scan Antenna," *Radar 97*, Publication No. 449, pp. 383–385 (Oct. 1997).

Sievenpiper, D. and Eli Yablonovitch, "Eliminating Surface Currents with Metallodielectric Photonic Crystals," 1998 *IEEE MTT–S International Microwave Symposium Digest*, vol. 2, pp. 663–666 (Jun. 7, 1998).

Ellis, T.J. and G.M. Rebeiz, "MM–Wave Tapered Slot Antennas on Micromachined Photonic Bandgap Dielectrics," *1996 IEEE MTT–S International Microwave Symposium Digest*, vol. 2, pp. 1157–1160 (1996).

Linardou, I., et al., "Twin Vivaldi antenna fed by coplanar waveguide," *Electronics Letters*, vol. 33, No. 22, pp. 1835–1837 (Oct. 23, 1997).

Schaffner, J.H., et al., "Reconfigurable Aperture Antennas Using RF MEMS Switches for Multi–Octave Tunability and Beam Steering," *IEEE*, pp. 321–324 (2000).

Sievenpiper, D., et al., "Low–profile, four–sector diversity antenna on high–impedance ground plane," *Electronics Letters*, vol. 36, No. 16, pp. 1343–1345 (Aug. 3, 2000).

* cited by examiner

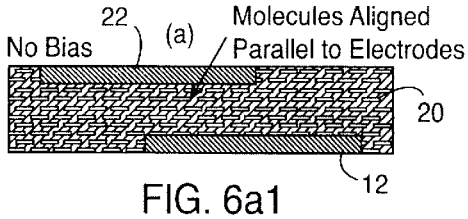
FIG. 6a1
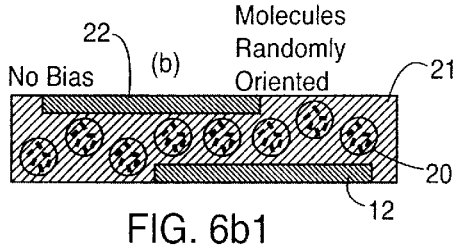
FIG. 6b1
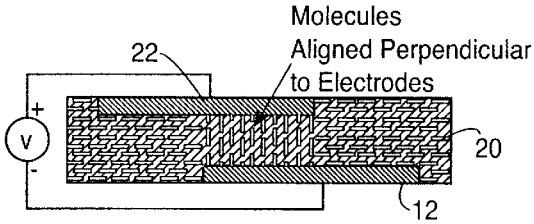
FIG. 6a2
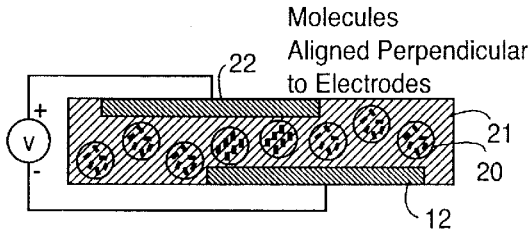
FIG. 6b2
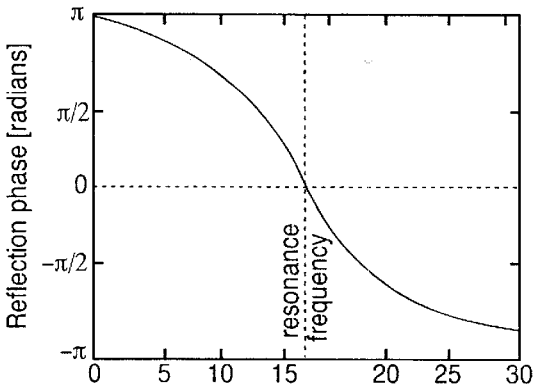
FIG. 3
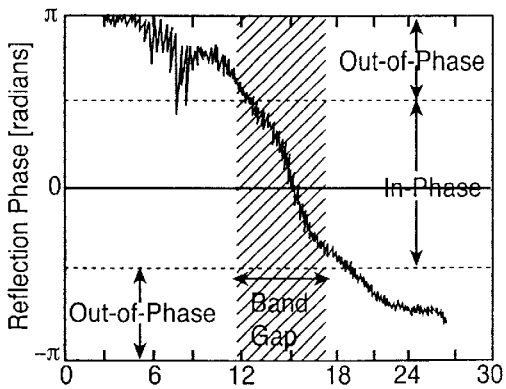
FIG. 4

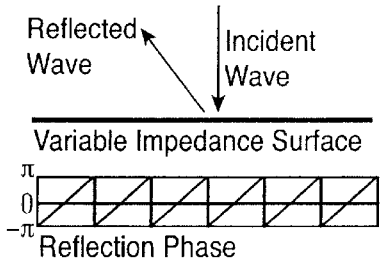
FIG. 10
FIG. 11a
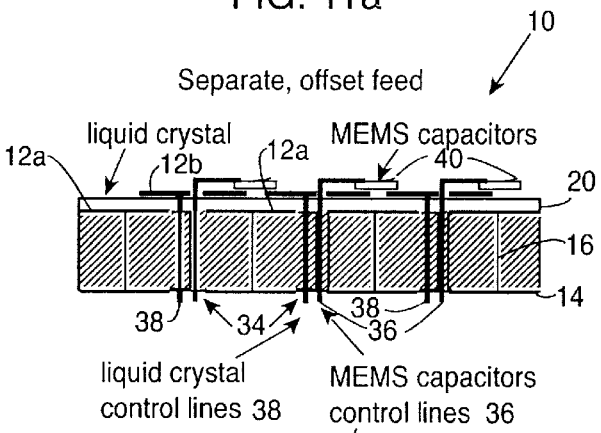
FIG. 12a
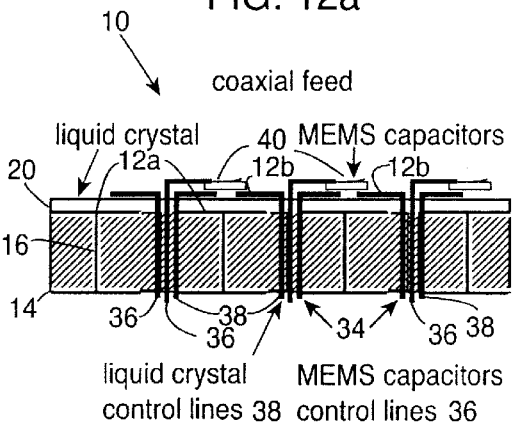
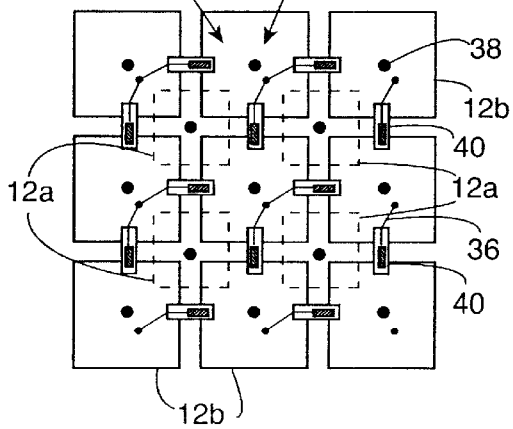
FIG. 11b
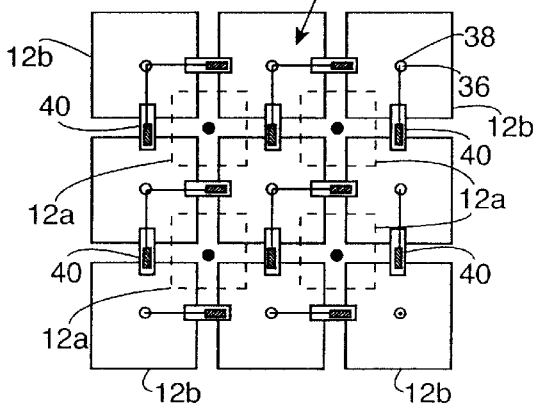
FIG. 12b

ELECTRONICALLY TUNABLE REFLECTOR

FIELD OF THE INVENTION

The present invention relates to a surface which reflects radio-frequency, including microwave radiation, and which imparts a phase shift to the reflected wave which is electrically tunable, using liquid crystals or other electrically tunable medium.

BACKGROUND OF INVENTION

There is an existing need for materials and/or surfaces which can steer (or focus) a radio frequency electromagnetic beam. Such materials and/or surfaces can be very useful in various applications such as radio frequency communication systems, including satellite communication system.

The present application is related to (i) U.S. patent application Ser. No. 09/537,923 entitled "A Tunable Impedance Surface" filed Mar. 29, 2000 (ii) U.S. patent application Ser. No. 09/537,921 entitled "An End-Fire Antenna or Array on Surface with Tunable Impedance" filed Mar. 29, 2000 and to (iii) U.S. patent application Ser. No. 09/520,503 entitled "A Polarization Converting Radio Frequency Reflecting Surface" filed Mar. 8, 2000 the disclosures of which are all hereby incorporated herein by this reference. U.S. patent application Ser. No. 09/537,923 for a "Tunable Impedance Surface" describes a method and apparatus for mechanically tuning the surface impedance of a Hi-Z surface and thus its reflection phase using various mechanical methods. By programming the reflection phase as a function of position on this surface, the reflected beam can be steered or focused Prior art approaches for radio frequency beam steering generally involve using phase shifters or mechanical gimbals. With the present invention, beam steering is accomplished electronically using variable capacitors, thus eliminating expensive phase shifters and unreliable mechanical gimbals. Furthermore, the reflective scanning approach disclosed herein eliminates the need for a conventional phased array, with separate phase shifters on each radiating element. The tunable surface disclosed herein surface can serve as a reflector for any static, highly directed feed antenna, thus removing much of the complexity and cost of conventional, steerable antenna systems.

It is known in the prior art that an ordinary metal surface reflects electromagnetic radiation with a $\pi$ phase shift. However, a Hi-Z surface of the type disclosed in U.S. provisional patent application Ser. No. 60/079,953 is capable of reflecting radio frequency radiation with a zero phase shift.

A Hi-Z surface, shown in FIG. 1, consists of an array of metal protrusions or elements 12 disposed above a flat metal sheet or ground plane 14. It can be fabricated using printed circuit board technology, in which case the vertical connections are formed by metal vias 16, which connect the metal elements 12 formed on a top surface of a printed circuit board 18 (see FIG. 2) to a conducting ground plane 14 on the bottom surface of the printed circuit board 18. The metal elements 12 are arranged in a two-dimensional lattice, and can be visualized as mushrooms or thumbtacks protruding from the flat metal ground plane surface 14. The maximum dimension of the metal elements 12 on the flat upper surface is much less than one wavelength ($\lambda$) of the frequency of interest. Similarly, the thickness of the structure measures also much less than one wavelength of the frequency of interest.

The properties of the Hi-Z surface can be explained using an effective media model, in which it is assigned a surface impedance equal to that of a parallel resonant LC circuit. The use of lumped parameters to describe this electromagnetic structure is valid when the wavelength of interest is much longer than the size of the individual features, such as is the case here. When an electromagnetic wave interacts with the Hi-Z surface, it causes charges to build up on the ends of the top metal elements 12. This process can be described as governed by an effective capacitance C. As the charges travel back and forth, in response to the radio-frequency field, they flow around a long path through the vias 16 and the bottom ground plane 14. Associated with these currents is a magnetic field, and thus an inductance L. The effective circuit elements are illustrated in FIG. 2. The capacitance is controlled by the proximity of the adjacent metal elements 12, while the inductance is controlled by the thickness of the structure (i.e. the distance between the metal elements 12 and the ground plane 14).

The presence of an array or lattice of resonant LC circuits affects the reflection phase of the Hi-Z surface. For frequencies far from resonance, the surface reflects radio frequency waves with a $\pi$ phase shift, just as an ordinary conductor does. However, at the resonant frequency, the surface reflects with a zero phase shift. As a frequency of the incident wave is tuned through the resonant frequency of the surface, the reflection phase changes by one complete cycle, or $2\pi$. This is seen in both the calculated and measured reflection phases, as shown in FIGS. 3 and 4, respectively. FIG. 3 shows the calculated reflection phase of the high-impedance surface, obtained from the effective medium model. The phase crosses through zero at the resonance frequency of the structure. FIG. 4 shows that the measured reflection phase agrees well with the calculated reflection phase reinforcing the validity of the effective medium model.

When the reflection phase is near zero, the structure also effectively suppresses surface waves, which has been shown to be significant in antenna applications.

Structures of this type have been constructed in a variety of forms, including multi-layer versions with overlapping capacitor plates. Examples have been demonstrated with resonant frequencies ranging from hundreds of megahertz to tens of gigahertz, and the effective media model presented herein has proven to be an effective tool for analyzing and designing these materials, now known as Hi-Z surfaces.

BRIEF DESCRIPTION OF THE PRESENT INVENTION

The present invention involves a method and apparatus for tuning the reflection phase of the Hi-Z surface using a material which locally changes its dielectric constant in response to external stimuli. Liquid crystal materials can be used as the material which locally changes its dielectric constant. Alternatively, instead of liquid crystal materials, one can use suspended microtubules, suspended metal particles, ferroelectrics, or any other media which has an electrically, for example, tunable dielectric constant. Since this device is electronically reconfigurable, it requires no macroscopic mechanical motion. Instead, it uses electric field-induced molecular reorientation within a layer of liquid crystal material or other appropriate material to produce an electrically tunable capacitance. Tunable capacitors make up resonant elements which are distributed across the Hi-Z surface, and determine the reflection phase at each point on the surface. By varying the reflection phase as a function of position, a reflected wave can be steered electronically. In addition, this method and apparatus can be combined with mechanical techniques to create a hybrid structure which can allow for even more tunability.

Important features of the present invention include:

1. A structure which incorporates a liquid crystal material or other tunable material into the capacitive region of a Hi-Z surface to produce a surface with tunable reflection phase.
2. The disclosed structure and methods can be used to extend the useful bandwidth of a Hi-Z surface.
3. A method of steering or focusing a microwave or radio-frequency beam using a structure having a Hi-Z surface and a media which has an electrically tunable dielectric constant, such as a liquid crystal.

The present invention can be applied to a wide range of microwave and millimeter-wave antennas were quasi-optical elements can improve performance. The present invention has application in space-based radar and airborne communications node (ACN) systems whereby an aperture must be continually reconfigured for various functions. The present invention can be used to replace a fixed reflector with an adaptive planar reflector, and provide for beam direction and tracking. They are also many commercial applications for multi-functional apertures of the type which can be produced using the invention as disclosed wherein.

In one aspect the present invention provides a tuneable impedance surface for steering and/or focusing an incident radio frequency beam, the tunable surface comprising: a ground plane; a plurality of elements disposed a distance from the ground plane, the distance being less than a wavelength of the radio frequency beam; and a capacitor arrangement for controllably varying the capacitance of adjacent elements, the arrangement including a dielectric material which locally changes its dielectric constant in response to an external stimulus.

In another aspect the present invention provides a method of tuning a high impedance surface for a radio frequency signal. The method includes arranging a plurality of generally spaced-apart planar conductive surfaces in an array disposed essentially parallel to and spaced from a conductive back plane, the size of each conductive surface being less than a wavelength of the radio frequency signal and the spacing of each conductive surface from the back plane being less than a wavelength of the radio frequency signal; and varying the capacitance between adjacent conductive surfaces by locally varying a dielectric constant of a dielectric material to thereby tune the impedance of said high impedance surface.

BRIEF DESCRIPTION OF THE DRAWINGS

FIG. 3 depicts the calculated reflection phase of the high-impedance surface, obtained from the effective medium model and shows that the phase crosses through zero at the resonance frequency of the structure;

FIG. 4 shows that the measured reflection phase agrees well with the calculated reflection phase;

FIGS. 6*a*1 and 6*a*2 demonstrate the reaction of a homogeneous aligned liquid crystal to an applied electric field;

FIGS. 6*b*1 and 6*b*2 demonstrate the reaction of a polymer dispersed liquid crystal to an applied electric field;

FIG. 10 shows an incident wave and reflected wave reflected at a large angle from a electronically tunable surface with an indication of the change in phase function needed to effect the reflection;

FIGS. 11*a* and 11*b* are a side elevation view and a plan view of a tunable high impedance surface which uses MEMS tunable mechanical capacitors in addition a variable dielectric constant material to vary the impedance of the high impedance surface; and FIGS. 12*a* and 12*b* are a side elevation view and a plan view of another embodiment of a tunable high impedance surface which uses MEMS tunable mechanical capacitors in addition a variable dielectric constant material to vary the impedance of the high impedance surface.

DETAILED DESCRIPTION

Figure 5A:
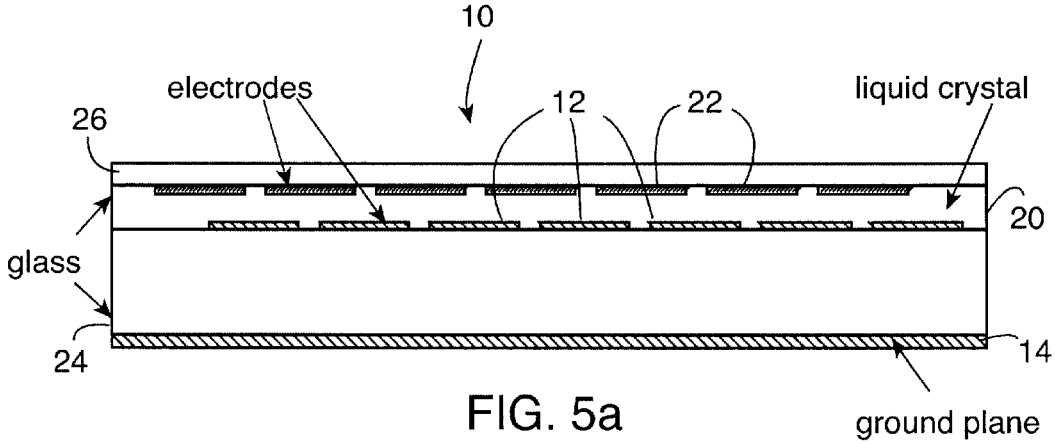
FIGS. 5*a* and 5*b* are schematic side elevation and plan views of a simple one-dimensional tunable high impedance surface.
Figure 5B:
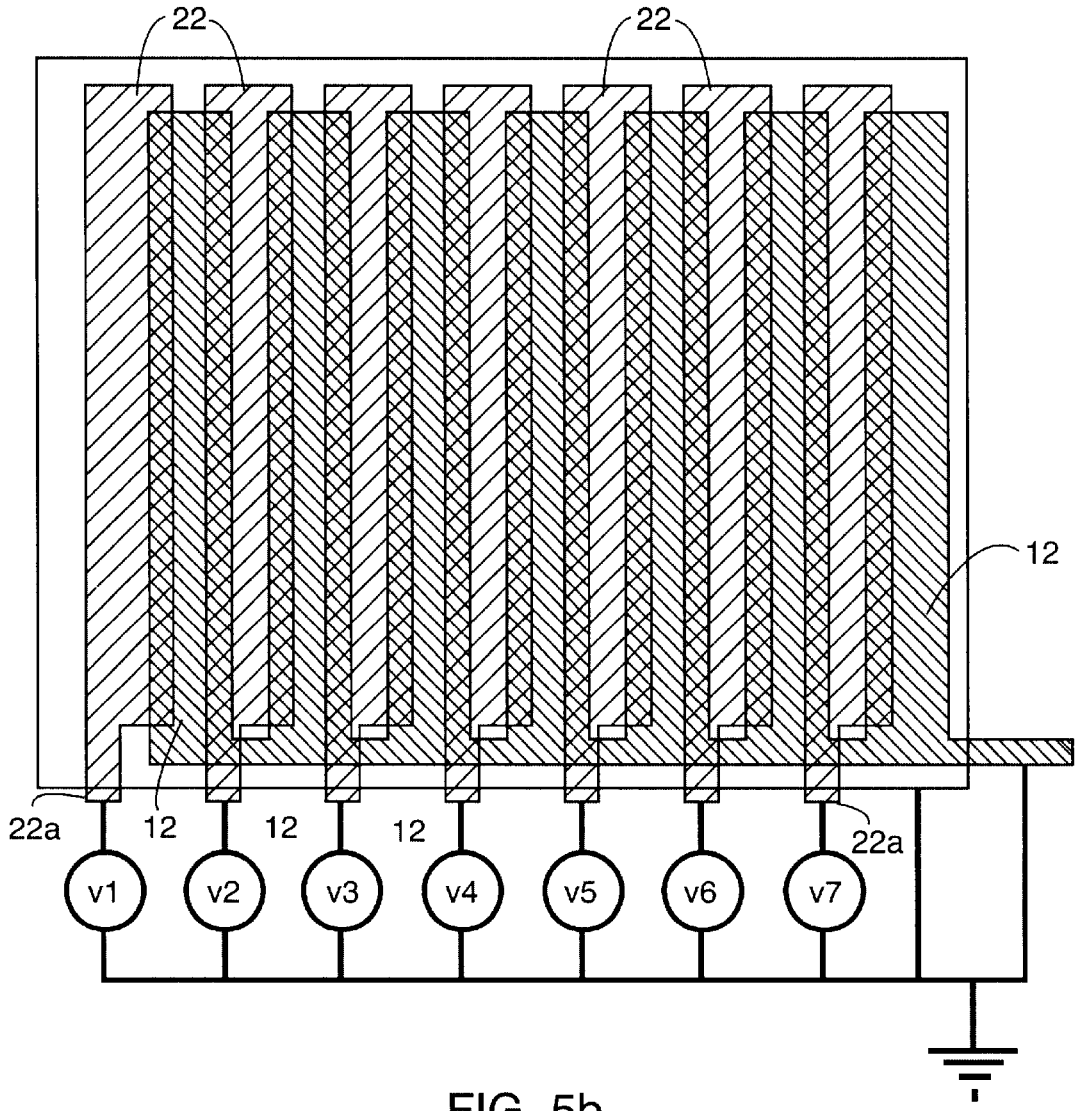

Turning to FIGS. 5*a* and 5*b*, a simple one-dimensional version of a tunable high impedance surface is depicted. By incorporating a tunable dielectric material 20 between or adjacent capacitor plates 12 and 22, the resonant frequency of the surface can be adjusted locally. Liquid crystal is used as a material for electronically tuning the reflection phase of a Hi-Z surface. Other materials can also be used in lieu of liquid crystal materials, such as suspended microtubules . By applying an AC electrical bias $v_1$–$v_N$ to the liquid crystal material via the plates 12 and 22, its dielectric constant can be changed through molecular reorientation, thereby tuning the resonant frequency of the Hi-Z surface. At a particular fixed frequency, this appears as a change in the reflection phase. From an alternative viewpoint, the frequency at which the reflection phase is zero will be changed as a function of the applied the voltage, thus allowing one to tune an antenna disposed above the surface. By applying different voltages $v_1$–$v_N$ to different regions of the surface, the reflection phase can thus be specified electronically as a function of position on the surface, allowing a reflected beam to be steered. This represents electrostatic steering, since motion only occurs at the molecular level in the liquid crystal material.

In this simplified, ideal form, the structure can be fabricated using thin strips of metal or other conductor, printed or otherwise formed on two separate layers of glass or other insulator 24, 26. The lower glass plate 24 has a metal ground plane 14 disposed on its rear surface and elements 12 of the type shown in FIG. 5 disposed on its front surface. The upper glass plate 26 has capacitor plates or electrodes 22 formed thereon. The two sheets of glass 24, 26 are disposed close and essentially parallel to each other, separated by a thin layer of liquid crystal material 20. Typically, the spacing is kept constant in liquid crystal devices by adding a small fractional volume of plastic spheres (not shown) which act as spacers. The thin strips of conductive material 22 have electrical connections 22*a* at the edges of the glass plate 26, which allow a bias voltage $v_1$–$v_N$ to be applied thereto relative to the ground plane 14. Alternatively, a segmented resister with taps for each electrode can be used to apply a voltage gradient to the structure.

Figure 1:
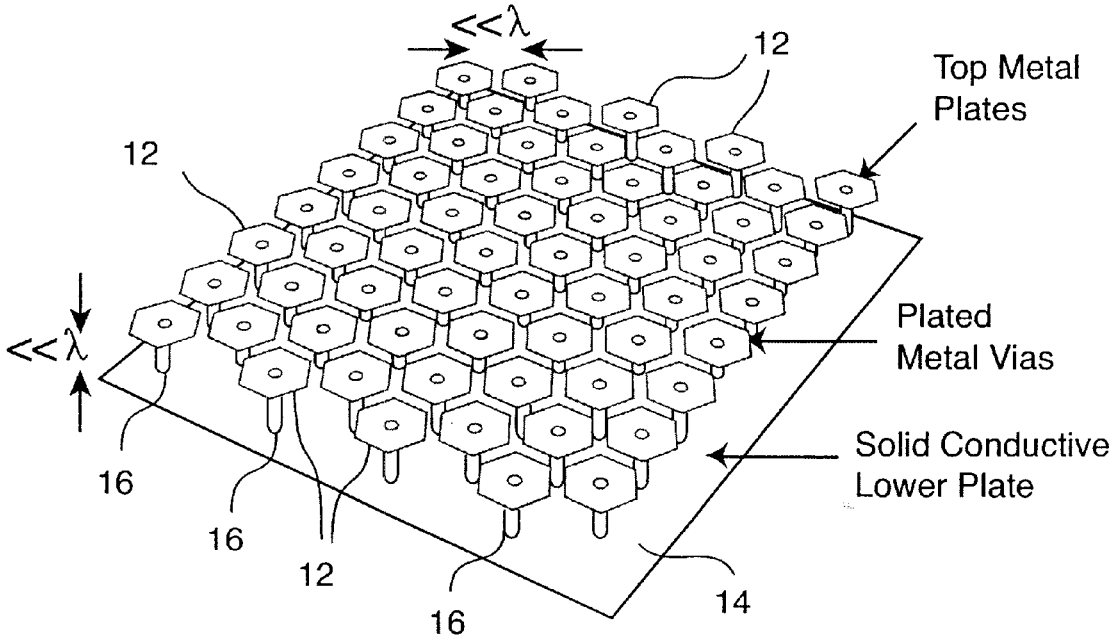
FIG. 1 (PRIOR ART)
FIG. 1 is a perspective view of high-impedance surface fabricated using printed circuit board technology of the type disclosed in U.S. Provisional Patent Ser. No. 60/079,953 and having metal plates on the top side connect through metal plated vias to a solid metal ground plane on the bottom side.

The basic geometry for such a surface is illustrated in FIGS. 5*a* and 5*b*. The vertical conducting vias shown FIG. 1 are absent here because they are only necessary for the suppression of surface waves and they can be removed without affecting the reflection phase. Also, only a few capacitor plates or electrodes 22 are shown in FIG. 5*a* and 5*b* for ease of illustration, it being recognized that, in practice, a large number of such plates or electrodes might well be used. Also, the mechanical details for constraining the liquid crystal or other material with suitable properties 20 between the two glass plates 24, 26 is not shown as those details are well known in the liquid crystal display technology art, for example.

Figure 2:
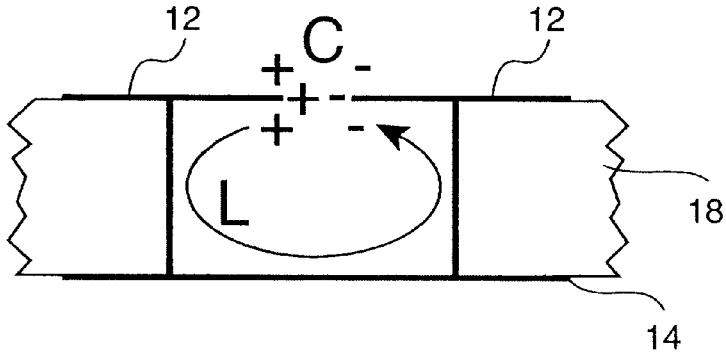
FIG. 2 (PRIOR ART)
FIG. 2 is a schematic diagram of an effective media model of the capacitance and inductance of the Hi-Z surface of FIG. 1.

The concept of using the liquid crystal material, for example, as a tunable capacitor is illustrated FIGS. 6*a*1 and 6*a*2. An embodiment utilizing a homogeneous aligned liquid crystal (or polymer disposed liquid crystal) is depicted by FIGS. 6*b*1 and 6*b*2. When no bias signal V is applied, the molecules of the liquid crystal material 20 are oriented parallel to the electrodes as shown in FIG. 6*a*1, an effect that is achieved through a well known surface treatment. See, for example, J. Cogard, *Mol. Cryst. Liq. Cryst. Suppl.* 1, 1 (1982), the disclosure of which is hereby incorporated herein by reference. When an DC or AC bias voltage V is applied between the electrodes 12, 22, the molecules align themselves along the applied electric field, as shown by FIG. 6*a*2. The effective dielectric constant is, in general, a tensor, whose properties depend on the orientation of the individual molecules. Thus, by selectively applying bias voltages and thus aligning the molecules differently in different parts of the device shown by FIGS. 5*a* and 5*b*, one can tune the dielectric constant along a particular direction. In the case of FIG. 5*b*, the tuning would be in the direction perpendicular to the major axes of the capacitor electrodes 22. If the applied voltage is a DC voltage then the liquid crystal can be considered as being are either "on" or "off". To obtain a fine control over the dielectric constant provided by the liquid crystal media, the applied voltage is preferably an AC voltage so that the crystal is switched on and off repetitively according to the frequency of the applied AC voltage. The dielectric constant also tends to change in the same fashion so that the time-wise average is controlled according to the shape of the applied AC voltage. The tuning of the dielectric constant also tunes the value of the capacitors and adjusts reflection phase of the surface. A polymer dispersed liquid crystal 20 may alternatively be used as is shown by FIGS. 6*b*1 and 6*b*2. Here the liquid crystal material 20 takes the form bubbles in a solid polymer 21. When no voltage V is applied, the molecules are randomly oriented, as shown in FIG. 6*b*1. When a voltage V is applied, they align perpendicular to the electrodes as shown by FIG. 6*b*2. This technique results in a relatively fast response and allows for a solid state construction. See J. W. Doane, N. A. Vaz, B. G. Wu and S. Zumer, *Appl. Phys. Lett.* 48, 269 (1986) the disclosure of which is hereby incorporated herein by reference.

In this application, the liquid crystal material is subjected to two different frequencies: (1) the AC bias, whose RMS value determines the orientation of the molecules within the liquid crystal material and (2) the radio frequency signal, which oscillates too fast to affect the liquid crystal.

The metal plates 12 and capacitors electrodes 22 are much smaller in size than the wavelength of interest, so a reflector of reasonable size may include hundreds or thousand or more of these tiny resonant elements. Each resonant element would contain a electrically tunable capacitor, which will allow the reflection phase to be tuned as a function of position on the surface. This enables a reflected beam to be steered in any direction by imparting a linear slope on the reflection phase. If the structure is not to be used for beam steering, but simply to extend the maximum operating bandwidth of a given Hi-Z surface, then the applied voltage would be a uniform function across the surface.

Figure 7:
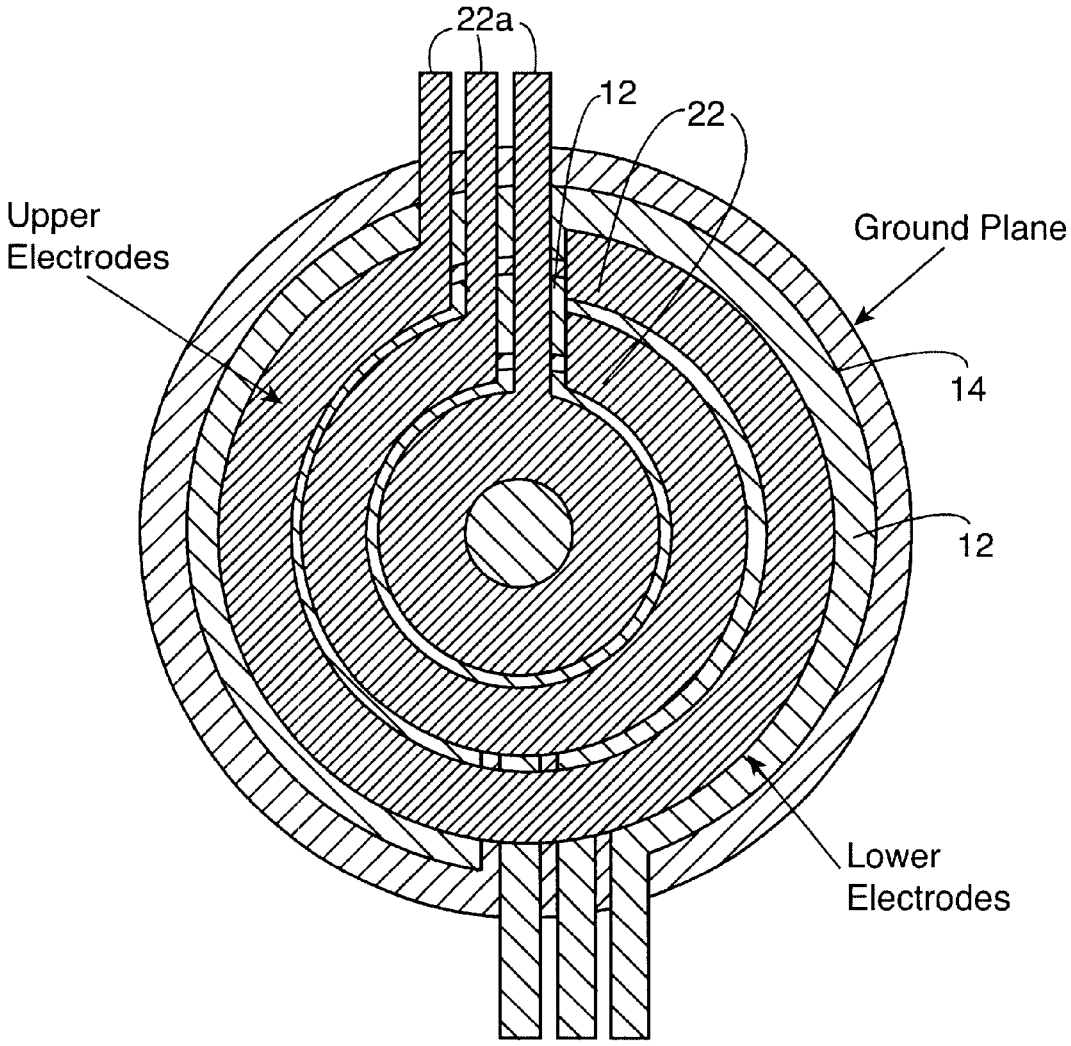
FIG. 7 is a schematic plan view of a simple ring-geometry tunable high impedance surface.

The same concept can be used to make a tunable focusing reflector, by using a ring geometry such as that shown in FIG. 7. Rings of metal may be fed from the edge or through a ground plane as will be described later. By varying the voltage applied across each pair of rings, a focusing reflector results with a tunable focal point. Again, only a few capacitor electrodes 22 are shown for ease of illustration, it being recognized that, in use, a Hi-Z surface would be provided with many such electrodes 22. Also, the tunable material 20 (such as a liquid crystal material) and other mechanical and electrical details are not shown for ease of illustration.

The fractional change in dielectric constant that is achievable in current commercial liquid crystal materials is on the order of 10%. However, materials with as much as 30% tunability are known in the prior art. See S. T. Wu et al., *Appl. Phys. Lett.* 74, 344 (1999), the disclosure of which is hereby incorporated herein by reference. If the geometry of the Hi-Z surface is chosen such that the reflected phase changes by $2\pi$, then any desired phase change can be achieved. For beam steering, a total phase change of $2\pi$ would be desirable, so the bandwidth of the Hi-Z surface should be kept small, by making the structure thin. This requirement is easily met by current Hi-Z surfaces.

The tunability of the liquid crystal material can also be used or alternatively be used to extend the bandwidth of the wide-band Hi-Z surface. In this case, the surface would be relatively thick to have the widest possible instantaneous bandwidth for a given applied voltage. The thicker the surface, the wider the instantaneous bandwidth. For a given thickness, the total available bandwidth can be increased by making the Hi-Z surface tunable—tuning it to whatever frequency is desired at a particular time. This effectively extends the maximum usable frequency range or "bandwidth," but not the frequency range available at any particular instant in time (i.e. the "instantaneous bandwidth"). However, if the goal of the user of the present invention is a structure with a large phase tunability, then a relatively narrow instantaneous bandwidth may well be preferred. This is because a narrow instantaneous bandwidth corresponds to a steep phase slope as a function of resonant frequency and thus a given change in dielectric constant. This can be an important consideration, especially if the material selected has a limited range of dielectric constant variability.

The simple reflector shown in FIGS. 5*a* and 5*b* is capable of one-dimensional (or single axis) scanning. A two-dimensional (or two orthogonal axes) version results from the geometry shown in FIGS. 8*a* and 8*b*. The T-shaped metal electrodes resemble elements 12 and 16 shown in the Hi-Z surface presented in FIG. 1. A structure of this design would be the most general, and would be used for both two-dimensional scanning and also for focusing. Of course, it can be used for one-dimensional scanning, if desired. In this embodiment, the bias lines 28 are preferably fed through the ground plane 14. This presents a potential problem with radio frequency leakage to the ground plane 14, which can be solved by using lines having very low radio frequency impedance, such as a coax cable with a relatively wide inner conductor, a spiral inductor structure or a low-pass LC filter 34. This would effectively short the radio frequency signal to the ground plane and prevent it from propagating through the backside, without affecting the AC bias signal, which would propagate on the bias lines 36 since the frequency of the AC bias signals $v_1$–$v_N$ are substantially less than the frequency of the RF signals reflected from the surface. An effective low pass filter is shown by detail view of FIG. 8*c*.

Figure 8A:
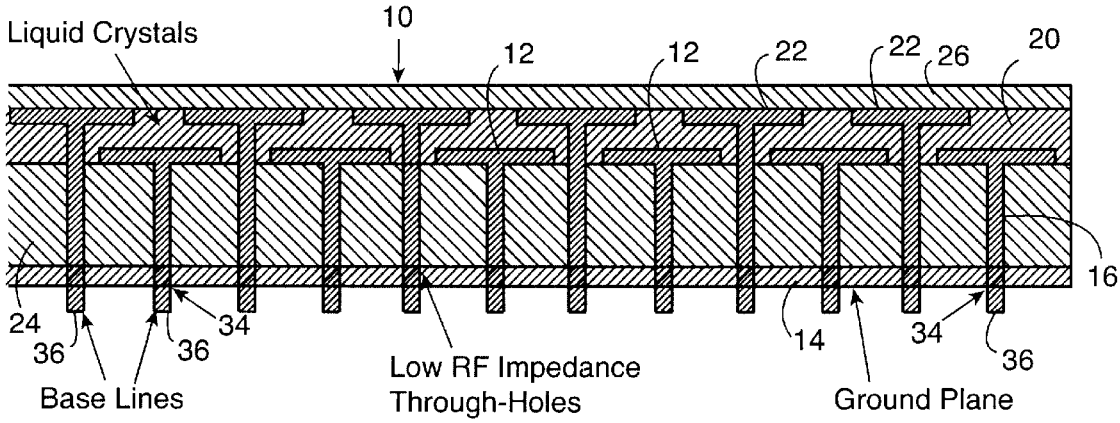
FIGS. 8*a* and 8*b* are schematic side elevation and plan views of a simple two-dimensional tunable high impedance surface.
Figure 8C:
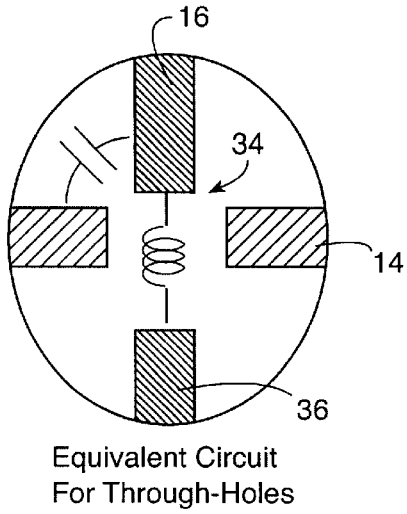
FIG. 8*c* shown an equivalent circuit for the bias lines passing through the ground plane.
Figure 8B:
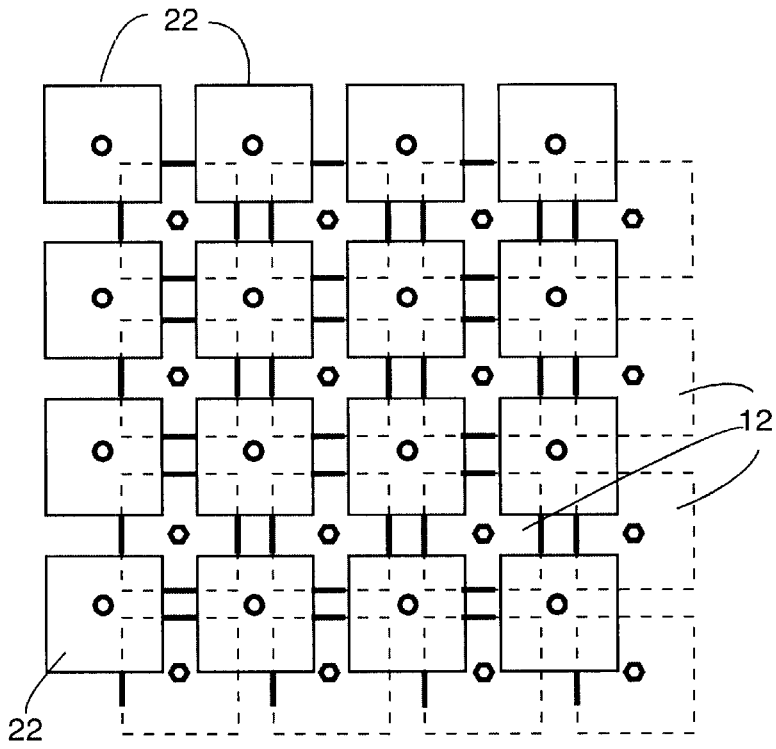

In the embodiment of FIGS. 5*a* and 5*b*, the elements 12 are not AC-coupled to the ground plane 14 (although they could be so coupled). In the embodiment of FIGS. 8*a* and 8*b*, elements 12 are AC-coupled to the ground plane 14 by LC filter 34. When the elements 12 are AC-coupled to the ground plane 14, then surface waves will be suppressed and the Hi-Z surface can have a zero reflection phase. A zero reflection phase is important, in some applications, since antenna elements can lie directly adjacent the Hi-Z surface 10. The suppression of surface waves is important in such applications because it improves the antenna's radiation pattern when the antenna is close enough that it would otherwise excite such surface waves (when within a wavelength or so). For example, if one or more antenna elements is mounted on or very near the tunable Hi-Z surface, such as the case of a dipole element adjacent or on the tunable Hi-Z surface, then it is very desirable to suppress the surface waves. However, if the antenna is relatively far from the tunable Hi-Z surface (more than a wavelength), such as in the case of a feed horn illuminating the tunable Hi-Z surface, then suppression of surface waves is of less concern and AC-coupling the elements 12 to the ground plane 14 may be omitted as is depicted by the embodiment of FIGS. 5*a* and 5*b*. In that embodiment the reflection phase can still be zero at some frequency and the surface is tunable using the techniques described herein.

Although the disclosed embodiments focus on embodiments which utilize liquid crystal materials, the present invention can be used with other materials. Other useful materials which can be used in lieu of liquid crystals include suspended microtubules, suspended metal particles, ferroelectrics, polymer dispersed liquid crystals and other tunable dielectrics.

Figure 9:
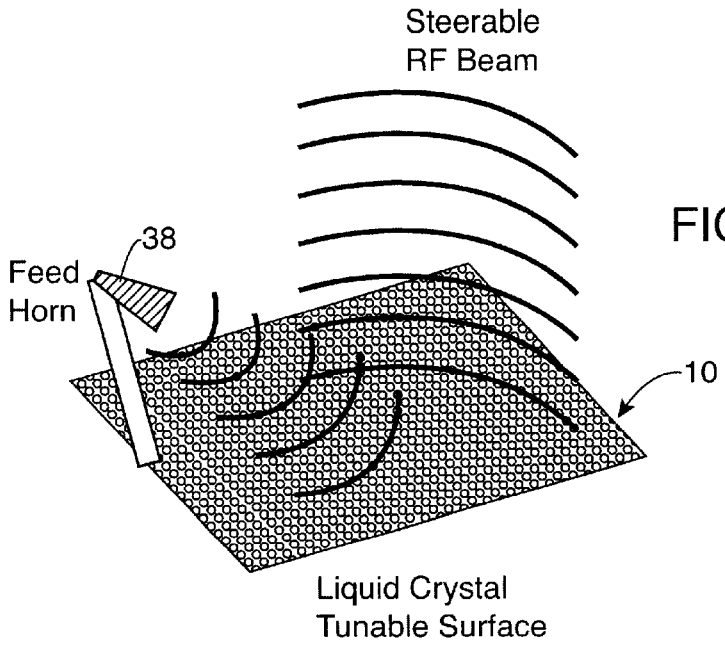
FIG. 9 depicts an electronically tunable surface acting as a steerable reflector for a stationary feed antenna.

A possible antenna using a reflector such as that previously shown is now depicted in FIG. 9. A stationary horn or other high-directivity feed structure 38 would illuminate the liquid crystal tunable surface 10. The bias applied to this surface, as a function of position, would determine the angle of the reflected beam. Using current liquid crystal technology, the beam can be steered in a matter of milliseconds. To steer to large angles, phase discontinuities of $2\pi$ would be used as shown in FIG. 10. In this case, the structure resembles a radio-frequency Fresnel parabolic reflector.

FIGS. 11*a* and 12*a* are a side elevation views of two different embodiments of a reflector having a tunable high impedance surface which uses MEMS tunable mechanical capacitors 40 in addition a variable dielectric constant material (such as a liquid crystal material 20—an upper glass layer to contain the liquid crystal material is not shown for the sake of ease of illustration) to vary the impedance of the high impedance surface 10. The MEMS tunable mechanical capacitors 40 are controlled by address lines 36. The elements 12 are arranged in two groups: one group 12*a* is directly (AC and DC) grounded to the back plane 14 by conductors 16 while the other group 12*b* is only AC grounded to the back plan 14 by LC filters 34. As such DC and comparatively low frequency AC control signals on lines 36 can be used to vary the capacitance contributed by MEMS capacitors 40. The capacitance contributed by the MEMS capacitor augments the capacitance contributed by the liquid crystal material 20. The capacitance contributed by the liquid crystal material is controlled by control voltages applied to liquid crystal control lines 38.

FIGS. 11*b* and 12*b* are top views of the two embodiments discussed above and correspond to FIGS. 11*a* and 11*b*, respectively. Group 12*a* of elements 12 are shown in phantom lines since they underlie the group 12*b* which generally is disposed above them in the elevation views discussed above.

The embodiment of FIGS. 11*a* and 11*b* and the embodiment of FIGS. 12*a* and 12*b* are similar. In the embodiment of FIGS. 12*a* and 12*b* the MEMS capacitor control lines are supplied co-axially of the liquid crystal control lines 38. In the embodiment of FIGS. 11*a* and 11*b* the MEMS capacitor control lines are routed parallel to, but offset from, the liquid crystal control lines 38.

As can be seen, in these embodiments the MEMS capacitors 40 are connected between adjacent top elements in group 12*b*. However, the MEMS capacitors 40 could (i) also or alternatively be connected between adjacent elements 12*a* and/or (ii) also or alternatively connect adjacent elements 12 in different groups (in which case the MEMS capacitors 40 would bridge the gap between the elements in group 12*a* and the elements in group 12*b*).

The term "dielectric constant" is well known in the electric and electronic arts. The term relates to a physical property of materials and doubtlessly when the term was adopted the property was viewed as being a "constant" for each given material. As technology has progressed, materials have been discovered for which this physical property of a "dielectric constant" can vary for one reason or another. This invention takes advantage of such materials to provide a tunable reflector. In liquid crystal materials, the physical property of a dielectric constant is often referred to as "birefringence".

Having described the invention in connection with certain embodiments thereof, modification will now certainly suggest itself to those skilled in the art. As such, the invention is not to be limited to the disclosed embodiments except as required by the appended claims.

What is claimed is:

1. A tuneable impedance surface for steering and/or focusing an incident radio frequency beam, the tunable surface comprising:

(a) a ground plane;

(b) a plurality of elements spaced from the ground plane by a distance or distances less than a wavelength of the radio frequency beam; and (b) a capacitor arrangement for controllably varying the capacitance of adjacent elements including a dielectric material which locally changes its dielectric constant in response to an external stimulus.

2. The tuneable impedance surface of claim 1 further including an insulator for supporting said ground plane on one major surface thereof and for supporting a first group of said plurality of elements on another major surface thereof.

3. The tuneable impedance surface of claim 2 further including a second insulator for supporting a second group of said plurality of elements on a major surface thereof.

4. The tuneable impedance surface of claim 3 wherein said capacitor arrangement is adjustable to electrically tune the impedances of said plurality of elements, said external stimulus being provided by a plurality of AC bias signals.

5. The tuneable impedance surface of claim 4 wherein the plurality of elements each have an outside dimension which is less than the wavelength of the radio frequency beam.

6. The tuneable impedance surface of claim 5 wherein the first group of elements is coupled to the ground plane.

7. The tuneable impedance surface of claim 6 wherein the second group of elements is coupled to receive the AC bias signals.

8. The tuneable impedance surface of claim 7 wherein the second insulator is disposed in a spaced, parallel relationship to the first mentioned insulator, the dielectric material which locally changes its dielectric constant in response to an external stimulus being disposed between the two insulators.

9. The tuneable impedance surface of claim 8 wherein the dielectric material which locally changes its dielectric constant in response to an external stimulus is a liquid crystal material.

10. The tuneable impedance surface of claim 9 wherein the plurality of elements are arranged in a two dimensional array.

11. The tuneable impedance surface of claim 9 wherein the plurality of elements are arranged in a one dimensional array.

12. The tuneable impedance surface of claim 4 further including a plurality of MEMS capacitors coupled between adjacent ones of said plurality of elements.

13. The tuneable impedance surface of claim 12 wherein said plurality of MEMS capacitors are coupled between adjacent ones of said second group of elements.

14. The tuneable impedance surface of claim 1 further including a plurality of MEMS capacitors coupled between adjacent ones of said plurality of elements.

15. The tuneable impedance surface of claim 1 wherein said plurality of elements are grouped into first and second groups, the first group being coupled to said ground plane and the second group receiving said external stimulus.

16. The tuneable impedance surface of claim 15 wherein the external stimulus is a bias voltage.

17. A method of tuning a high impedance surface for a radio frequency signal comprising:

arranging a plurality of generally spaced-apart planar conductive surfaces in an array disposed essentially parallel to and spaced from a conductive back plane, the size of each conductive surface being less than a wavelength of the radio frequency signal and the spacing of each conductive surface from the back plane being less than a wavelength of the radio frequency signal; and varying the capacitance between adjacent conductive surfaces by locally varying a dielectric constant of a dielectric material to thereby tune the impedance of said high impedance surface.

18. The method of claim 17 wherein said plurality of generally spaced-apart planar conductive surfaces are arranged on an insulator.

19. The method of claim 17 wherein the step varying the capacitance between adjacent conductive surfaces in said array includes providing bias signals to capacitor electrodes disposed adjacent said dielectric material.

20. The method of claim 17 further including providing MEMS capacitors between adjacent ones of said spaced-apart planar conductive surfaces and wherein the step of varying the capacitance between adjacent conductive surfaces includes applying bias signals to said MEMS capacitors.

21. A tunable reflective surface for a radio frequency signal comprising:

a conductive ground plane;

a plurality of generally spaced-apart planar conductive surfaces in an array disposed essentially parallel to and spaced from the ground plane, the size of each conductive surface being less than a wavelength of the radio frequency signal and the spacing of each conductive surface from the ground plane being less than a wavelength of the radio frequency signal; and a material having a locally varying dielectric constant disposed adjacent said plurality of generally spaced-apart planar conductive surfaces and spaced from said ground plane.

22. The tunable reflective surface of claim 21 wherein said plurality of generally spaced-apart planar conductive surfaces are arranged on an insulating substrate.

23. The tunable reflective surface of claim 22 further including a plurality of capacitor electrodes disposed adjacent said dielectric material and spaced from said plurality of generally spaced-apart planar conductive surfaces and means for providing bias signals to said capacitor electrodes disposed adjacent said dielectric material.

24. The tunable reflective surface of claim 23 wherein the plurality of generally spaced-apart planar conductive surfaces are disposed on the insulating substrate and wherein the plurality of capacitor electrodes are disposed on a second substrate.

25. A method of tuning a high impedance surface for reflecting a radio frequency signal therefrom, the method including:

arranging a plurality of generally spaced-apart planar conductive surfaces in an array disposed essentially parallel to and spaced from a conductive back plane, the size of each conductive surface being less than a wavelength of the radio frequency signal and the spacing of each conductive surface from the back plane being less than a wavelength of the radio frequency signal; and varying the capacitance between adjacent conductive surfaces while the radio frequency signal is being reflected from said high impedance surface by locally varying a dielectric constant of a dielectric material disposed adjacent to said conductive surfaces.

26. The method of claim 25 wherein said plurality of generally spaced-apart planar conductive surfaces are arranged on said dielectric material.

27. The method of claim 25 wherein the step varying the capacitance between adjacent conductive surfaces in said array includes providing bias signals to capacitor electrodes disposed adjacent said dielectric material.

28. The method of claim 25 further including providing MEMS capacitors between adjacent ones of said spaced-apart planar conductive surfaces and wherein the step of varying the capacitance between adjacent conductive surfaces includes applying bias signals to said MEMS capacitors.

* * * * *

UNITED STATES PATENT AND TRADEMARK OFFICE

CERTIFICATE OF CORRECTION

PATENT NO. : 6,552,696 B1 
DATED : April 22, 2003
INVENTOR(S) : Daniel Sievenpiper et al.

It is certified that error appears in the above-identified patent and that said Letters Patent is hereby corrected as shown below:

Column 1,
Line 2, please insert the following paragraph above FIELD OF THE INVENTION:

-- STATEMENT OF GOVERNMENT INTEREST
This invention was made with government support under Contract No. N6601-99-C-8635. The government has certain rights in this invention. --

Signed and Sealed this

Third Day of February, 2004

JON W. DUDAS
*Acting Director of the United States Patent and Trademark Office*